US008900001B2

(12) United States Patent
Li et al.

(10) Patent No.: US 8,900,001 B2
(45) Date of Patent: Dec. 2, 2014

(54) CARD EDGE CONNECTOR HAVING IMPROVED EJECTOR

(71) Applicant: Hon Hai Precision Industry Co., Ltd., New Taipei (TW)

(72) Inventors: Zhuang-Xing Li, Kunshan (CN); Xue-Hai Shen, Kunshan (CN); Xin-Wei Wang, Kunshan (CN); Xue-Wu Bu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 93 days.

(21) Appl. No.: 13/651,488

(22) Filed: Oct. 15, 2012

(65) Prior Publication Data

US 2013/0095679 A1 Apr. 18, 2013

(30) Foreign Application Priority Data

Oct. 13, 2011 (CN) ..... 2011 2 0389093

(51) Int. Cl.
*H01R 13/62* (2006.01)

(52) U.S. Cl.
USPC ..... 439/157

(58) Field of Classification Search
CPC ..... G06K 13/0806; H01R 13/633; H01R 13/6275; H01R 13/62938; H01R 13/62933; H05K 7/1409
USPC ..... 439/157, 159–160, 630
See application file for complete search history.

(56) References Cited

U.S. PATENT DOCUMENTS

| | | | | |
|---|---|---|---|---|
| 5,364,282 | A | 11/1994 | Tondreault | |
| 5,389,000 | A * | 2/1995 | DiViesti et al. | 439/157 |
| 5,730,611 | A * | 3/1998 | Cheng et al. | 439/160 |
| 5,746,614 | A | 5/1998 | Cheng et al. | |
| 7,484,978 | B1 * | 2/2009 | Gao | 439/160 |
| 7,494,354 | B2 | 2/2009 | Mon et al. | |
| 7,828,566 | B2 | 11/2010 | Chen et al. | |
| 7,922,506 | B1 * | 4/2011 | Harlan et al. | 439/160 |

* cited by examiner

*Primary Examiner* — Xuong Chung Trans
(74) *Attorney, Agent, or Firm* — Wei Te Chung; Ming Chieh Chang

(57) ABSTRACT

A card edge connector (100) includes an insulative housing, a set of contacts (2) retained in the insulative housing and an ejector (3). The insulative housing has a central slot (12) and one tower portion (13) having a receiving slot (135). The contacts protrude into the central slot. The ejector has a main portion (31) received in the receiving slot, an ejecting portion (34) extending from a lower end (35) of the main portion, a locking portion (32) extending inwardly from an upper end of the main portion, and a lever portion (37) extending outwardly from the upper end of the main portion. The locking portion has a pair of vertical portions (324), and a transverse portion (323). The transverse portion connects the vertical portions and divides the vertical portions into upper and lower retaining parts.

20 Claims, 5 Drawing Sheets

CARD EDGE CONNECTOR HAVING IMPROVED EJECTOR

BACKGROUND OF THE INVENTION

1. Field of the Invention

The present invention relates to a card edge connector, more particularly to a card edge connector having an improved ejector.

2. Description of Related Art

Card edge connectors are employed widely in computers to receive a memory module, graphic card, network interface et al. The card edge connector usually includes an elongated insulative housing defining a central slot extending in a longitudinal direction for receiving the memory module, a plurality of contacts retained in the housing and projecting into the central slot for electrically mating with the memory module, and a pair of ejectors rotatably attached to two tower portions formed at two longitudinal ends of the insulative housing for ejecting and latching with the memory module.

The ejectors usually have main portions, ejecting portions extending inwardly from lower ends of the main portions for ejecting the memory module out of the central slot, locking portions extending inwardly from upper ends of the main portions for latching with the memory module, and lever portions extending outwardly from the upper ends of the main portions and opposed to the locking portion for being operated by hands conveniently. The main portions usually have spindles rotatably received in circular holes of the tower portions. When the memory module is completely inserted into the central slot, the locking portions protrude into cutouts formed on side edges of the memory module so that the memory module could be retained in a height direction. However, the memory module could not be retained by the ejector in a transverse direction perpendicular to both the longitudinal direction and the height direction.

Hence, an improvement over the prior art is required to overcome the disadvantages thereof.

BRIEF SUMMARY OF THE INVENTION

According to one aspect of the present invention, a card edge connector comprises a longitudinal insulative housing, a plurality of contacts retained in the insulative housing for mating with the memory module and an ejector. The insulative housing has a central slot extending along a longitudinal direction for insertion of a memory module, and at least one tower portion extending upwardly from one longitudinal end thereof and defining a receiving slot. The contacts protrude into the central slot for mating with the memory module. The ejector is received in the receiving slot of the tower portion and rotatable inwardly or outwardly relative to the tower portion for latching the memory module into the central slot or ejecting the memory module out of the central slot. The ejector has a main portion received in the receiving slot, an ejecting portion extending from a lower end of the main portion for ejecting the memory module out of the central slot, a locking portion extending inwardly from an upper end of the main portion for latching the memory module into the central slot, and a lever portion extending outwardly from the upper end of the main portion for being handled by a hand or others. The locking portion comprises a pair of vertical portions extending in a height direction and spaced apart from each other in a transverse direction perpendicular to both the longitudinal direction and the height direction, and a transverse portion extending in the transverse direction and located between the vertical portions for latching a cutout formed on a side edge of the memory module. The transverse portion connects the vertical portions and divides the vertical portions into upper and lower retaining parts in the height direction for retaining upper and lower sides of the side edge separated by the cutout.

According to another aspect of the present invention, a card edge connector comprises a longitudinal insulative housing, a plurality of contacts retained in the insulative housing for mating with the memory module and an ejector. The insulative housing has a central slot extending along a longitudinal direction for insertion of a memory module, and at least one tower portion extending upwardly from one longitudinal end thereof. The tower portion defines a receiving slot and a pair of circular holes located at two sides of the receiving slot in the transverse direction perpendicular to the longitudinal direction. The contacts protrude into the central slot for mating with the memory module. The ejector has a main portion received in the receiving slot and defining a pair of spindles rotatably received in the corresponding circular holes, an ejecting portion extending from a lower end of the main portion for ejecting the memory module out of the central slot, a "H" shaped locking portion extending inwardly from an upper end of the main portion for latching the memory module into the central slot, and a lever portion extending outwardly from the upper end of the main portion for being handled by a hand or others. The locking portion comprises a pair of vertical portions extending in a height direction perpendicular to both the longitudinal direction and the transverse direction, and a transverse portion extending in the transverse direction and connecting between the vertical portions to form upper and lower grooves. When the memory module is inserted into the central slot, the transverse portion latches into a cutout formed on a side edge of the memory module to retain the memory module in the height direction, the upper and lower grooves receive upper and lower sides of the side edge separated by the cutout to retain the memory module in the transverse direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
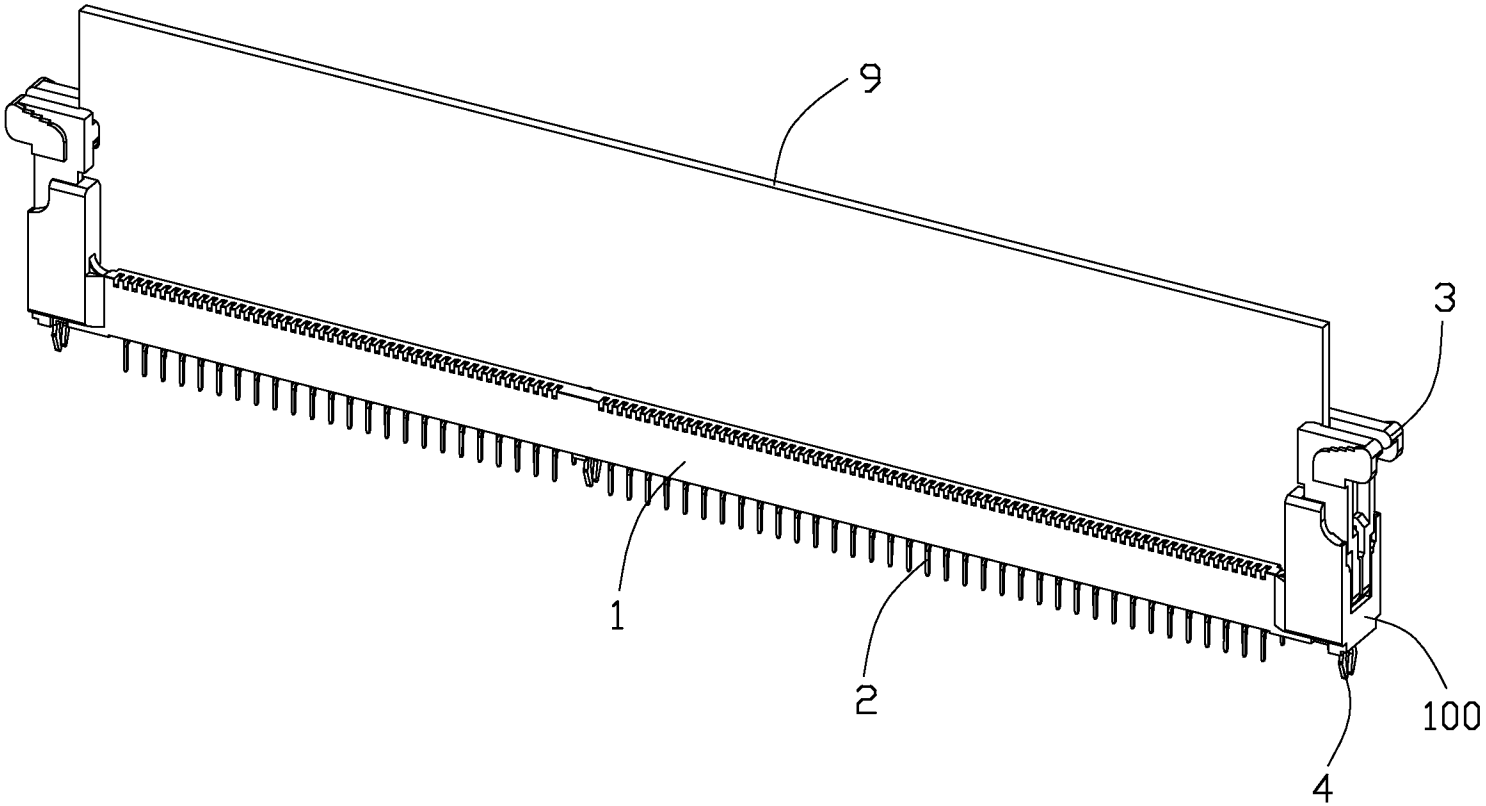
FIG. 1 is a perspective view of a card edge connector with a memory module being inserted therein according to an embodiment of the present invention.
Figure 2:
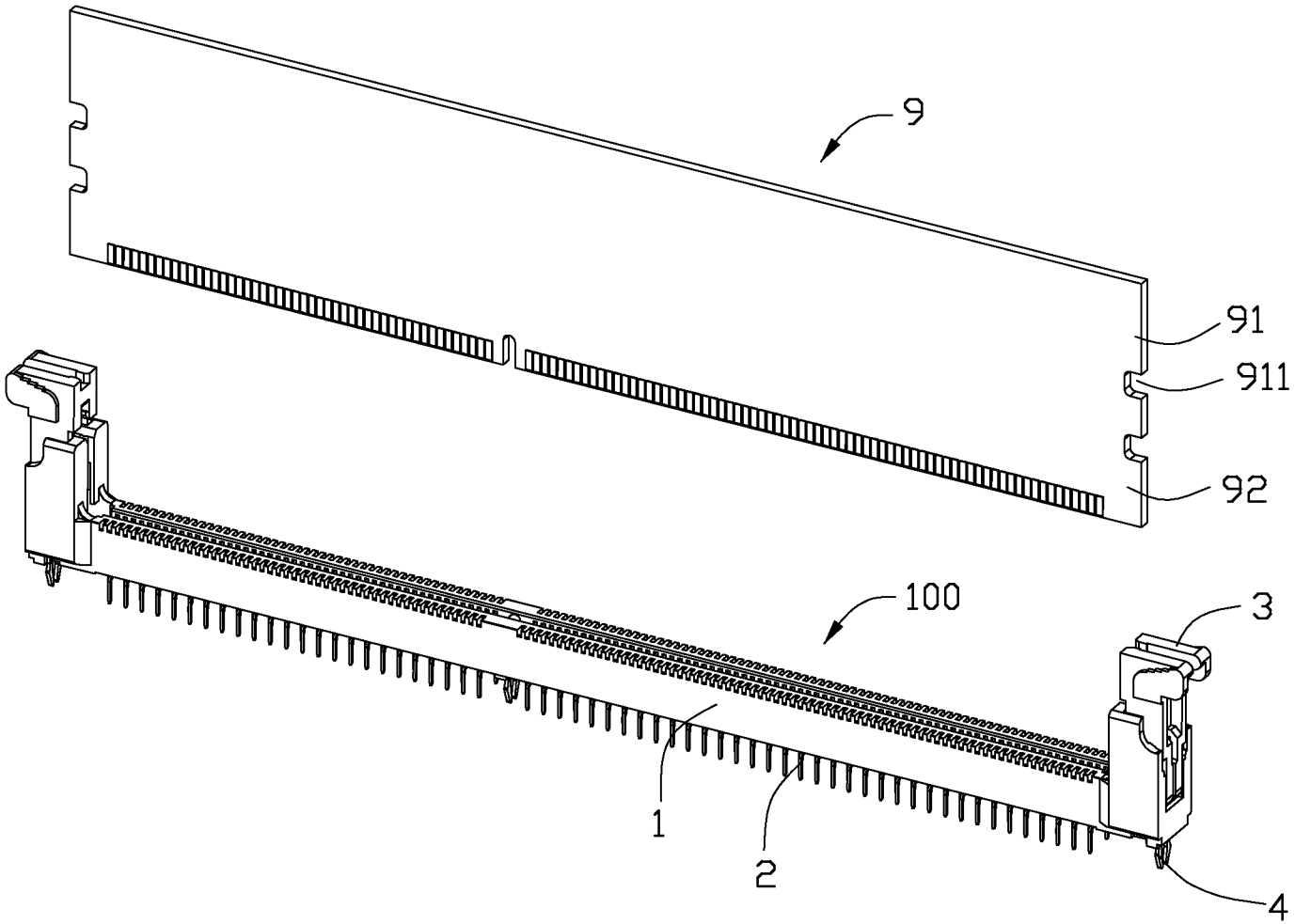
FIG. 2 is a perspective view showing the memory module detached from the card edge connector.
Figure 3:
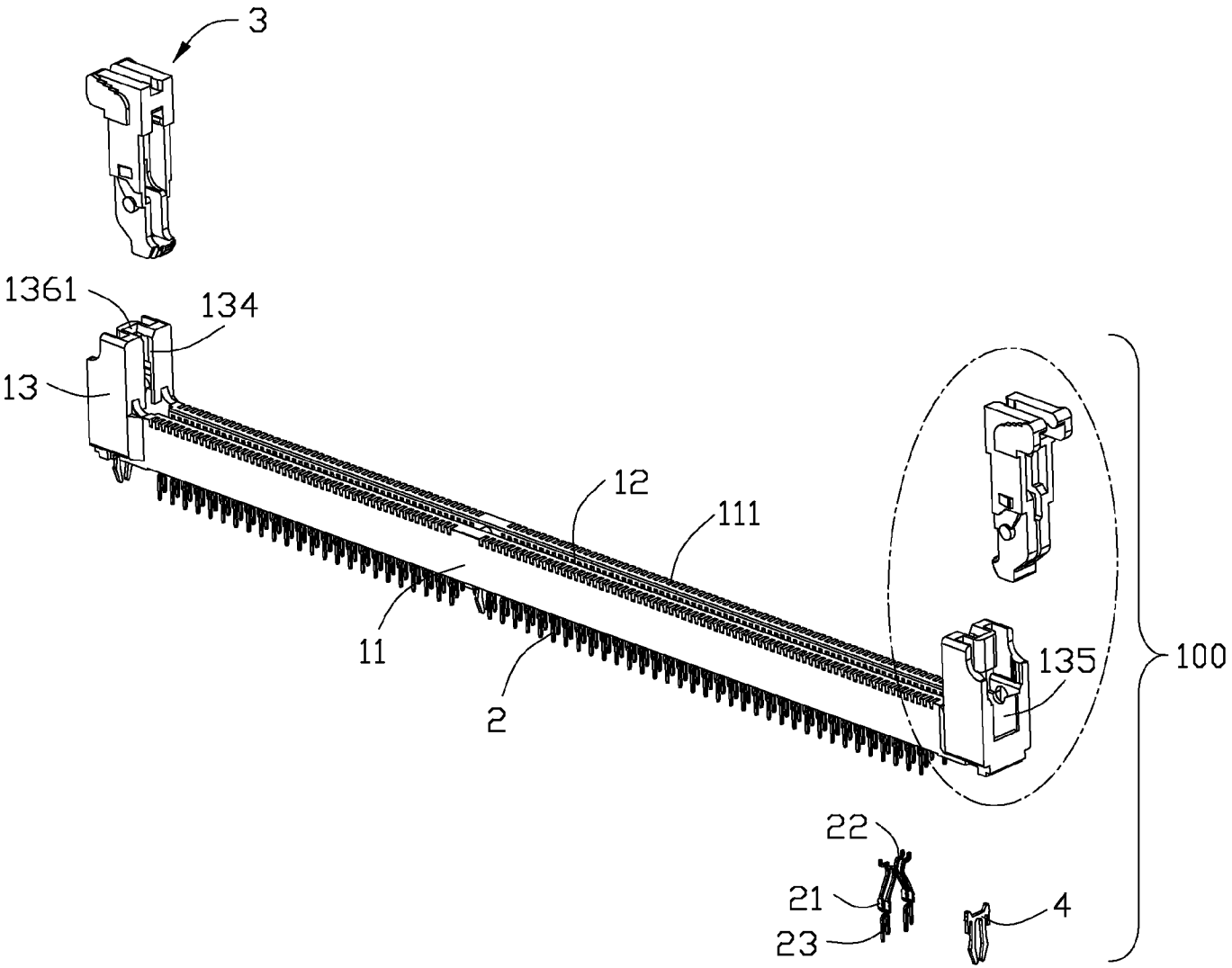
FIG. 3 is a partly exploded view of the card edge connector shown in FIG. 2.

Referring to FIGS. 1-3, a card edge connector 100 according to an embodiment of the present invention is used for being vertically mounted onto a printed circuit board (not shown) and adapted for insertion of a memory module 9. The card edge connector 100 comprises a longitudinal insulative housing 1, a set of contacts 2 retained in the insulative housing 1, a pair of ejectors 3 assembled to two longitudinal ends of the insulative housing 1, and a pair of board locks 4 assembled to the insulative housing 1 for being mounted onto the printed circuit board.

Figure 4:
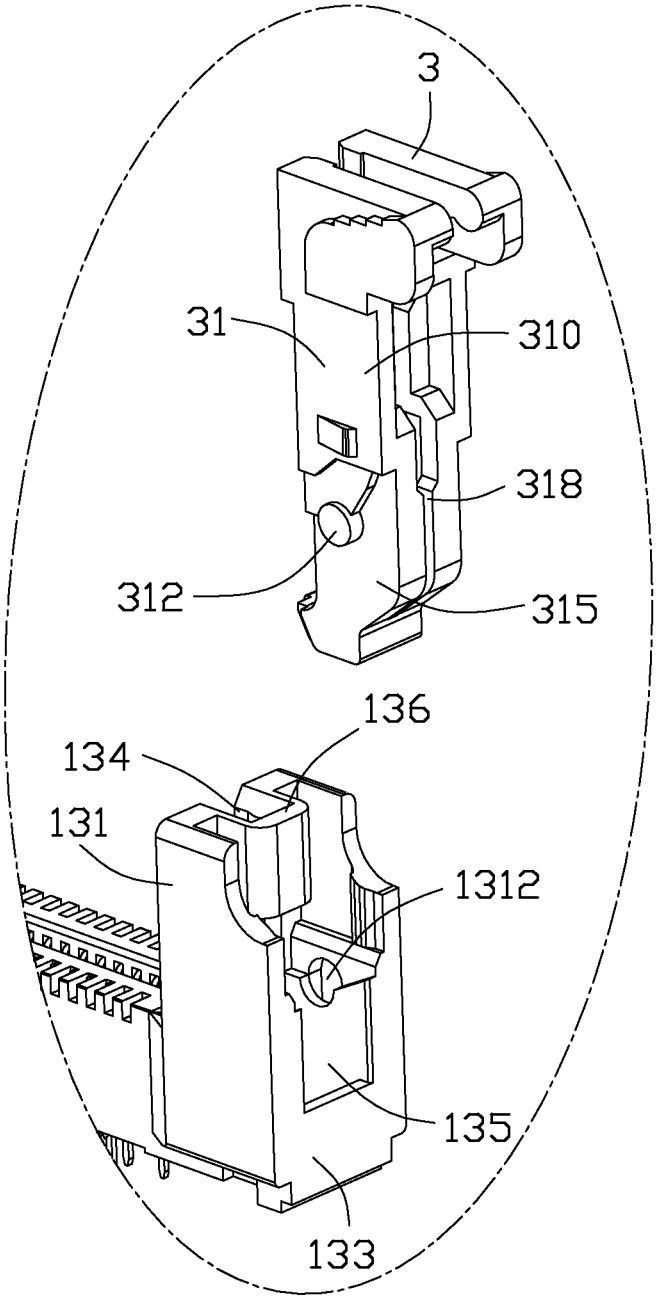
FIG. 4 is an enlarged view of a circle portion shown in FIG. 3.
Figure 5:
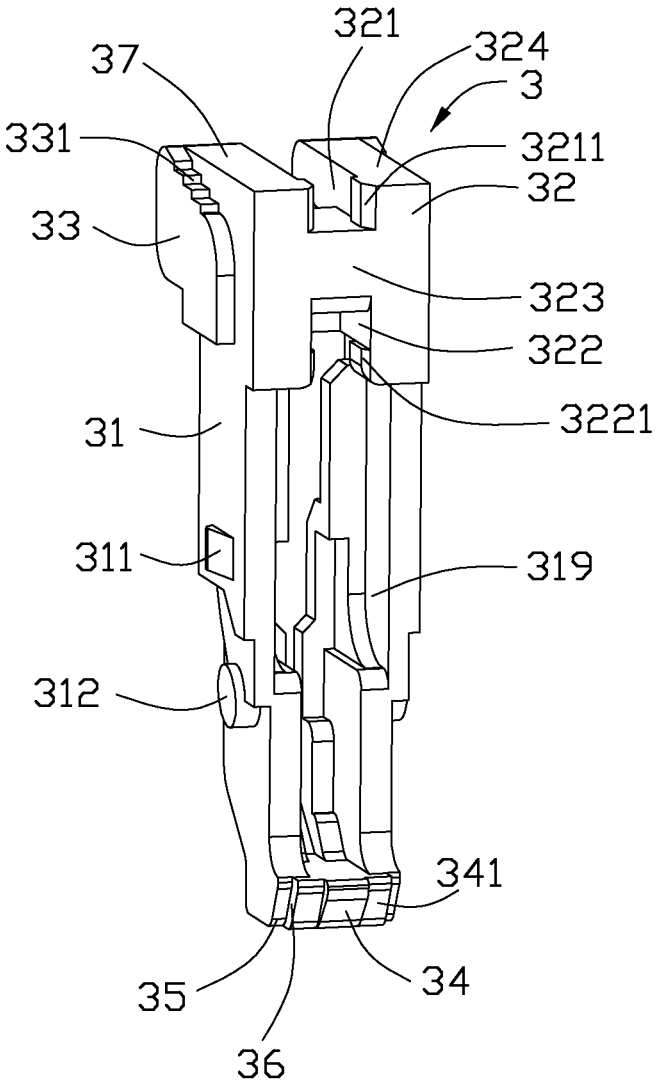
FIG. 5 is a perspective view of an ejector of the card edge connector shown in FIG. 4.

Referring to FIGS. 3 and 4, the insulative housing 1 has a pair of side walls 11 extending along a longitudinal direction, a longitudinal central slot 12 located between the side walls 11 for insertion of the memory module 9, and a pair of tower portions 13 located at the two longitudinal ends thereof and extending upwardly beyond the side walls 11. Each side wall 11 has a plurality of cavities 111 arranged along the longitudinal direction and communicating with the central slot 12 in a transverse direction perpendicular to the longitudinal direction. The cavities 111 pass through the respective side walls 11 in a height direction perpendicular to both the transverse direction and the longitudinal direction.

Each tower portion 13 has a pair of outer walls 131 extending in the height direction, a receiving slot 135 located between the outer walls 131 and communicating with the central slot 12 in the longitudinal direction, a U-shaped portion 136 connecting upper sides of the outer walls 131 and located at an inner side of the receiving slot 135, and an end wall 133 connecting lower sides of the outer walls 131 and located at an outer side of the receiving slot 135. The U-shaped portion 136 forms a recess 134 for receiving a side edge 91 of the memory module 9 and defines a guiding surface 1361 at an upper side thereof for guiding the memory module 9 into the central slot 12. A circular hole 1312 is formed on an inner side of the outer wall 131 and communicates with the receiving slot 135.

The contacts 2 have retaining portions 21 retained in the cavities 111, contacting portions 22 extending upwardly from the respective retaining portions 21 and protruding into the central slot 12 for mating with the memory module 9, and tail portions 23 extending downwardly from the respective retaining portions 21 for being mounted onto the printed circuit board.

Referring to FIGS. 2-5, each ejector 3 has a main portion 31 received in the receiving slot 135, an ejecting portion or a kicker 34 extending from a lower end 35 of the main portion 31 for ejecting the memory module 9 out of the central slot 12, an "H" shaped locking portion or a locker 32 extending inwardly from an upper end of the main portion 31 for latching the memory module 9 into the central slot 12, and a lever portion 37 extending outwardly from and opposite to the locking portion 32. The lever portion 37 extends horizontally and has an upper face coplanar with an upper face of the locking portion 32 so that the height of the card edge connector could be decreased. The lever portion 37 has a pair of operating portions 33 formed at two sides thereof in the transverse direction and each defining a wavy upper face 331 extending obliquely for being handled by a hand or others so as to operate the ejector 3 easily.

The main portion 31 has a slit 318 extending therein at an outer side thereof along the height direction to enhance its flexibility so that the ejector 3 could be assembled to the insulative housing 1 smoothly, and a chamber 319 formed at an inner side thereof to receive the U-shaped portion 136. The main portion 31 comprises an upper wide portion 310 defining a pair of protrusions 311 formed at two sides thereof for interferingly engaging with the outer walls 131 when the ejector 3 rotate relative to the insulative housing 1, and a lower narrow portion 315 extending downwardly from the wide portion 310 and being narrower than the wide portion 310. A pair of spindles 312 are formed at two sides of the narrow portion 315 and are rotatably received in the corresponding circular holes 1312 so that the ejector 3 could rotate inwardly or outwardly relative to the insulative housing 1 along the longitudinal direction.

The locking portion 32 has a pair of vertical portions 324 extending in a height direction of the card edge connector 100 and spaced apart from each other in the transverse direction, and a transverse portion 323 extending in the transverse direction and connecting the vertical portions 324 to latch a cutout 911 formed on the side edge 91 of the memory module 9. Therefore, the locking portion 32 forms an upper groove 321 above the transverse portion 323 for receiving an upper side of the side edge 91 above the cutout 911, and a lower groove 322 below the transverse portion 323 for receiving a lower side of the side edge 91 below the cutout 911. In other words, the transverse portion 323 connects the vertical portions 324 and divide the vertical portions 324 into upper and lower retaining parts in the height direction for retaining the upper and lower sides of the side edge 91 separated by the cutout 911. The vertical portions 324 have a pair of first protrusions 3211 projecting into the upper groove 321 for resisting the upper side of the memory module 9, and a pair of second protrusions 3221 projecting into the lower groove 322 for resisting the lower side of the memory module 9. The upper groove 321 passes through the lever portion 37 in the longitudinal direction so as to separate the lever portion 37 into two parts.

Referring to FIG. 9, each ejecting portion 34 has a pair of ribs 341 formed at two sides thereof so as to strengthen the ejecting portion 34. The ribs 341 and the lower end 35 of the main portion 31 form two steps 36 for resisting two steps formed on the insulative housing 1 when the ejector 3 rotate outwardly so as to prevent the ejector 3 from over-rotation.

Referring to FIGS. 1-5, when the memory module 9 is inserted into the central slot 12, the ejectors 3 rotate inwardly toward the central slot 12 from an open position as a lower edge 92 of the memory module 9 pressing the ejecting portions 34 of the ejectors 3 downwardly, the transverse portions 323 of the locking portions 32 latch into the cutouts 911 of the memory module 9 so as to retain the memory module 9 in the height direction. the vertical portions 325 clamp both the upper sides and the lower sides of the side edges 91 separated by the cutouts 911 so as to retain the memory module 9 in the transverse direction. Therefore, the memory module 9 could be retained in the card edge connector 100 reliably. When the memory module 9 is ejected from the central slot 12, the ejectors 3 are drove and rotate outwardly relative to the insulative housing 1 to eject the memory module 9 out of the central slot 12 via pushing the upper faces of the lever portions 37 downwardly or driving the operating portions 33 by hands or others.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card edge connector comprising:

a longitudinal insulative housing having a central slot extending along a longitudinal direction for insertion of a memory module, and at least one tower portion extending upwardly from one longitudinal end thereof and defining a receiving slot;

a plurality of contacts retained in the insulative housing and protruding into the central slot for mating with the memory module; and an ejector received in the receiving slot of the tower portion and being rotatable inwardly or outwardly relative to the tower portion for latching the memory module into the central slot or ejecting the memory module out of the central slot, the ejector having a main portion received in the receiving slot, an ejecting portion extending from a lower end of the main portion for ejecting the memory module out of the central slot, a locking portion extending inwardly from an upper end of the main portion for latching the memory module into the central slot, and a lever portion extending outwardly from the upper end of the main portion for being handled by a hand or others; wherein the locking portion comprises a pair of vertical portions extending in a height direction and spaced apart from each other in a transverse direction perpendicular to both the longitudinal direction and the height direction, and a transverse portion extending in the transverse direction and located between the vertical portions for latching a cutout formed on a side edge of the memory module, the transverse portion connects the vertical portions and divides the vertical portions into upper and lower retaining parts in the height direction, both the upper and lower retaining parts are located above the tower portion for sandwiching respective upper and lower sides of the side edge both exceeding the tower portion and separated by the cutout.

2. The card edge connector according to claim 1, wherein the upper retaining part comprises a pair of first protrusions projecting toward each other from the vertical portions for resisting the upper side of the side edge above the cutout, each of the first protrusions extends in the longitudinal direction and defines a chamfered guiding face at an inner side thereof in the longitudinal direction.

3. The card edge connector according to claim 1, wherein the lower retaining part comprises a pair of second protrusions projecting toward each other from the vertical portions for resisting the lower side of the side edge below the cutout, each of the second protrusions extends in the height direction and defines a chamfered guiding face at a lower side thereof in the height direction.

4. The card edge connector according to claim 1, wherein the lever portion is opposite to the locking portion in the longitudinal direction and defines an upper face coplanar with an upper face of the locking portion.

5. The card edge connector according to claim 4, wherein the lever portion has a pair of operating portions formed at two sides thereof in the transverse direction, each operating portion defines a wavy upper face lower than the upper face of the lever portion.

6. A card edge connector comprising:

a longitudinal insulative housing having a central slot extending along a longitudinal direction for insertion of a memory module, and at least one tower portion extending upwardly from one longitudinal end thereof, the tower portion defining a recess formed at an inner side thereof for receipt with a side edge of the memory module, a receiving slot at an outer side thereof, and a pair of circular holes located at two sides of the receiving slot in the transverse direction perpendicular to the longitudinal direction;

a plurality of contacts retained in the insulative housing and protruding into the central slot for mating with the memory module; and an ejector having a main portion received in the receiving slot and defining a pair of spindles rotatablely received in the corresponding circular holes, an ejecting portion extending from a lower end of the main portion for ejecting the memory module out of the central slot, a "H" shaped locking portion extending inwardly from an upper end of the main portion for latching the memory module into the central slot, and a lever portion extending outwardly from the upper end of the main portion for being handled by a hand or others; wherein the locking portion comprises a pair of vertical portions extending in a height direction perpendicular to both the longitudinal direction and the transverse direction, and a transverse portion extending in the transverse direction and connecting between the vertical portions to form upper and lower grooves respectively facing upwardly and downwardly, when the memory module is inserted into the central slot, the transverse portion latches into a cutout formed on the side edge of the memory module to retain the memory module in the height direction, the upper and lower grooves are located above the tower portion under condition that the lower groove is aligned with the recess in the height direction, and closely sandwich upper and lower sides of the side edge both exceeding the tower portion and separated by the cutout to retain the memory module in the transverse direction.

7. The card edge connector according to claim 6, wherein the vertical portions have a pair of first protrusions projecting into the upper groove to resist the upper side of the side edge of the memory module, each first protrusion extends in the longitudinal direction and defines a chamfered guiding face at an inner side thereof in the longitudinal direction.

8. The card edge connector according to claim 6, wherein the vertical portions have a pair of second protrusions projecting into the lower groove to resist the lower side of the side edge of the memory module, each second protrusion extends in the height direction and defines a chamfered guiding face at a lower side thereof adjacent to the recess in the height direction.

9. The card edge connector according to claim 6, wherein the lever portion extends horizontally and is opposite to the locking portion in the longitudinal direction, the lever portion defines an upper face coplanar with an upper face of the locking portion.

10. The card edge connector according to claim 9, wherein the lever portion has a pair of operating portions protruding from two sides thereof in the transverse direction.

11. The card edge connector according to claim 10, wherein each operating portion defines a wavy upper face extending upward obliquely in the longitudinal direction and lower than the upper face of the lever portion.

12. The card edge connector according to claim 10, wherein the upper groove extends outwardly through the lever portion in the longitudinal direction to separate the lever portion into two parts.

13. A card edge connector for use with a card edge module, comprising:

an elongated insulative housing defining a central slot extending along a longitudinal direction;

a plurality of contacts disposed in the housing by two sides of the central slot;

a pair of towers located at two opposite longitudinal ends of the housing in said longitudinal direction, each of said towers defining an inner U-shaped recess for receiving a side region of the card edge module, and an outer receiving slot to receive a corresponding ejector, said ejector being pivotally mounted into the outer receiving slot about a pivot extending in a transverse direction perpendicular to said lengthwise direction, each of said ejector further including an lower kicker located below the inner U-shaped recess in a vertical direction perpendicular to both said longitudinal direction and said transverse direction for upwardly ejecting a bottom edge of the card edge module, and an upper locker located above the inner U-shaped recess in said vertical direction for receipt with a notch formed in said side region of the card edge module; wherein said locker includes a transverse portion for reception within the notch of the side region of the card edge module, and at least a pair of protrusions formed around the transverse portion to define therebetween a groove for intimately sandwiching the side region of the card edge module in the transverse direction and above said inner U-shaped recess in the vertical direction.

14. The card edge connector as claimed in claim 13, wherein said pair of protrusion is located above the transverse portion.

15. The card edge connector as claimed in claim 14, wherein said locker further includes another pair of protrusions located proximate below the transverse portion.

16. The card edge connector as claimed in claim 15, wherein said locker defines an H-shaped configuration viewed in the longitudinal direction.

17. The card edge connector as claimed in claim 13, wherein each of said pair of protrusions is equipped with a tapered guiding surface facing toward an exterior in the longitudinal direction when said ejector is located in a locked position for compliance with an engagement, via a rotational movement, between the ejector and the card edge module while the inner U-shaped recess is equipped with another tapered guiding surface facing toward the exterior in the vertical direction for compliance with another engagement, via a downward insertion, between the inner receiving recess and the card edge module.

18. The card edge connector as claimed in claim 13, wherein said pair of protrusions is spaced from the transverse portion in the vertical direction when said ejector is located in a locked position.

19. The card edge connector as claimed in claim 15, wherein said another pair of protrusions is closely next to the transverse portion in the vertical direction when said ejector is located in the locked position.

20. The card edge connector as claimed in claim 15, wherein each of said another pair of protrusions is equipped with a tapered guiding surface facing inwardly toward an exterior in the longitudinal direction when said ejector is located in a locked position for compliance with an engagement, via a rotational movement, between the ejector and the card edge module.

* * * * *